US006305042B1

(12) United States Patent
Lalli

(10) Patent No.: US 6,305,042 B1
(45) Date of Patent: Oct. 23, 2001

(54) WRINGER ROLLER MOP WITH ROTATABLE ABSORBENT PAD

(75) Inventor: Anthony Lalli, Medford, NJ (US)

(73) Assignee: New Knight, Inc., Yeadon, PA (US)

( * ) Notice: Subject to any disclaimer, the term of this patent is extended or adjusted under 35 U.S.C. 154(b) by 0 days.

(21) Appl. No.: 09/397,210

(22) Filed: Sep. 16, 1999

Related U.S. Application Data

(60) Provisional application No. 60/100,734, filed on Sep. 17, 1998.

(51) Int. Cl.[7] ..... A47L 13/12; A47L 13/144

(52) U.S. Cl. ..... 15/119.2; 15/118

(58) Field of Search ..... 15/116.1, 116.2, 15/118, 244.1, 119.1, 119.2

(56) References Cited

U.S. PATENT DOCUMENTS

| | | | | |
|---|---|---|---|---|
| 2,896,235 | * | 7/1959 | Clements | 15/118 |
| 4,491,998 | | 1/1985 | Wilson . | |
| 4,604,767 | * | 8/1986 | Burkhart | 15/119.2 |
| 5,483,720 | * | 1/1996 | Decoopman | 15/119.2 |
| 5,528,791 | | 6/1996 | Wilson . | |
| 5,625,918 | | 5/1997 | Kieson . | |
| 5,655,248 | | 8/1997 | Kieson . | |
| 5,865,551 | | 2/1999 | Lalli . | |
| 5,896,613 | * | 4/1999 | Courtney | 15/118 |
| 6,000,087 | * | 12/1999 | Petner | 15/118 |
| 6,026,530 | * | 2/2000 | Camp, Jr. | 15/119.2 |

* cited by examiner

*Primary Examiner*—Randall E. Chin
(74) *Attorney, Agent, or Firm*—Dann, Dorfman, Herrell and Skillman; Stephen H. Eland

(57) ABSTRACT

A cleaning device having a cleaning head and an absorbent head is provided. The cleaning head is operable to clean a surface, and the absorbent head is operable to remove residual liquid remaining on the surface being cleaned. The cleaning head is attached to the distal end of a handle and is pivotally connected to the absorbent head. An actuator on the handle is displaceable in two positions to control the position of the cleaning head and absorbent head. In a first position, the cleaning head extends from the handle to clean the surface while the absorbent head is retracted. In a second position, the cleaning head is wrung while the absorbent head is pivoted to an extended position to absorb residual liquid on the cleaning surface.

5 Claims, 2 Drawing Sheets

WRINGER ROLLER MOP WITH ROTATABLE ABSORBENT PAD

This application claim benefit to provisional application Ser. No. 60/100,734 filed Sep. 17, 1997.

FIELD OF THE INVENTION

The present invention relates to cleaning devices. Specifically, the present invention relates to wringer roller mops, and more specifically to a wringer roller mop having an absorbent pad rotatably mounted on a cleaning head.

BACKGROUND OF THE INVENTION

Wringer roller mops are well-known in the industry. Such devices include a cleaning head in the form of a polyurethane or polyester sponge. To wring the sponge, the sponge is drawn between a pair of rollers that straddle the sponge. Although the rollers are effective in wringing most of the liquid from the sponge, a certain amount of liquid remains in the sponge after wringing so that the sponge may tend to push liquid around on a surface rather than absorbing the liquid. Accordingly, when using a wringer roller mop, frequently an undesirable amount of residual fluid is left on the surface being cleaned.

SUMMARY OF THE INVENTION

In light of the foregoing, the present invention provides a cleaning device having a cleaning head for cleaning a surface and an absorbent pad pivotally connected to the cleaning head. The cleaning head is attached to the distal end of a handle. An actuator pivotally connected to the handle is operable between first and second positions. Displacing the actuator from the first position to the second position operates to wring the cleaning head. The absorbent pad is pivotally connected to the cleaning head, and is formed of a material having a greater absorbency then the cleaning head. Displacing the actuator from the first position to the second position pivots the absorbent pad from the retracted position to an extended position.

BRIEF DESCRIPTION OF THE DRAWINGS

The foregoing summary as well as the following detailed description of the preferred embodiment of the present invention will be better understood when read in conjunction with the appended drawings, in which.

DETAILED DESCRIPTION OF THE PREFERRED EMBODIMENTS

Figure 1:
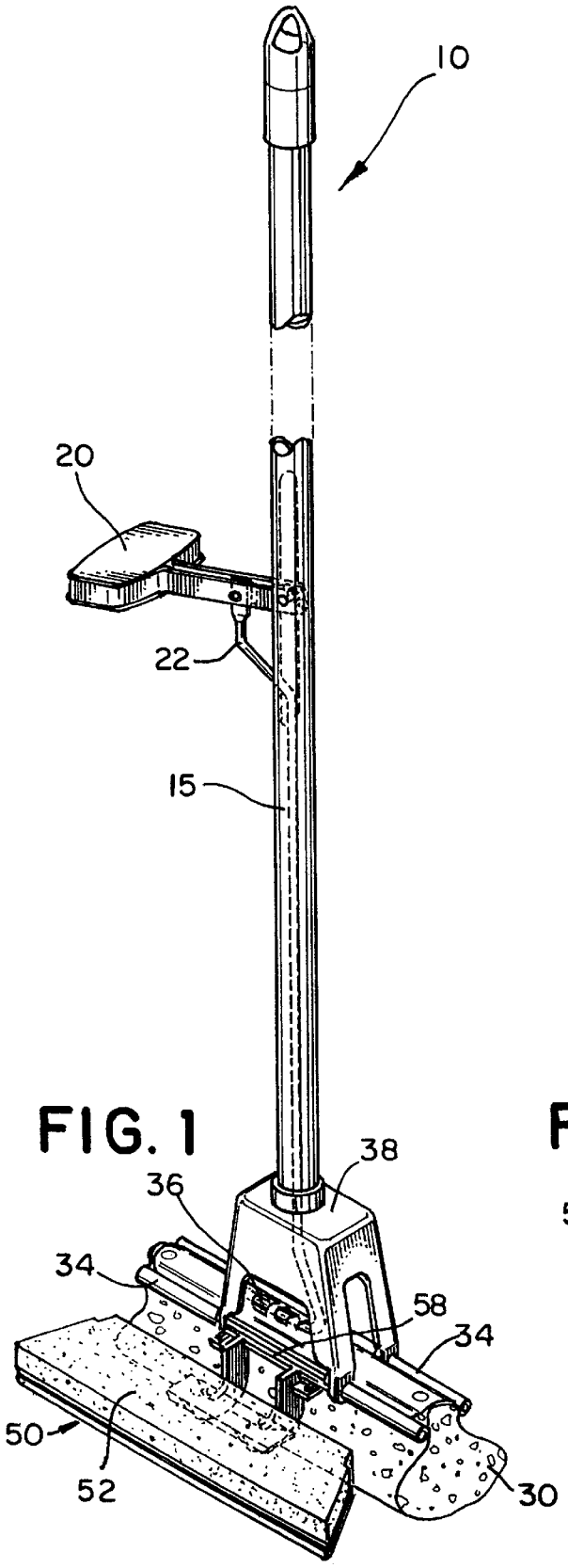
FIG. 1 is a perspective view of a cleaning device according to the present invention.

Referring now to the drawings in general and to FIG. 1 specifically, a wringer roller mop with a pivotable absorbent pad is designated generally 10. The mop includes a mop head 30 attached to the distal end of an elongated handle 15. An absorbent wiper 50 is pivotally connected to the mop head 30. An actuator 20 on the handle 15 operates to effectuate wringing of the mop head 30. When the mop head 30 is displaced into the wringing position, the wiper 50 is simultaneously pivoted into an extended position so that the user can readily use the wiper to absorb any residual liquid remaining on the surface being cleaned.

Figure 2:
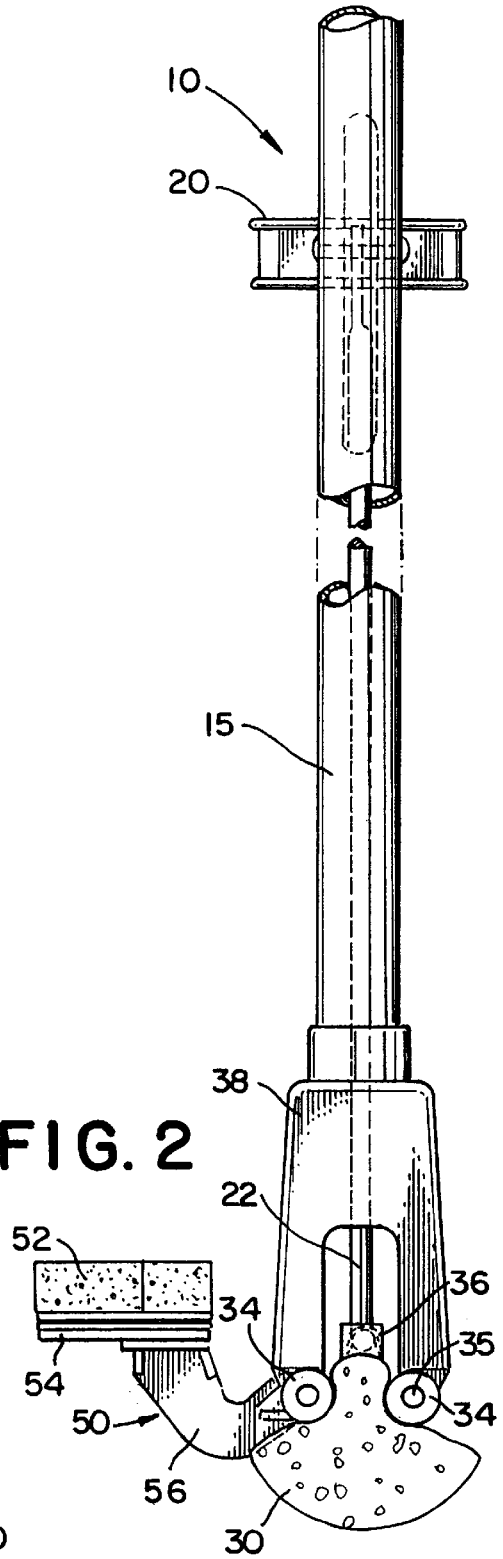
FIG. 2 is an enlarged fragmentary right-side elevation view of the cleaning device illustrating in FIG. 1.
Figure 3:
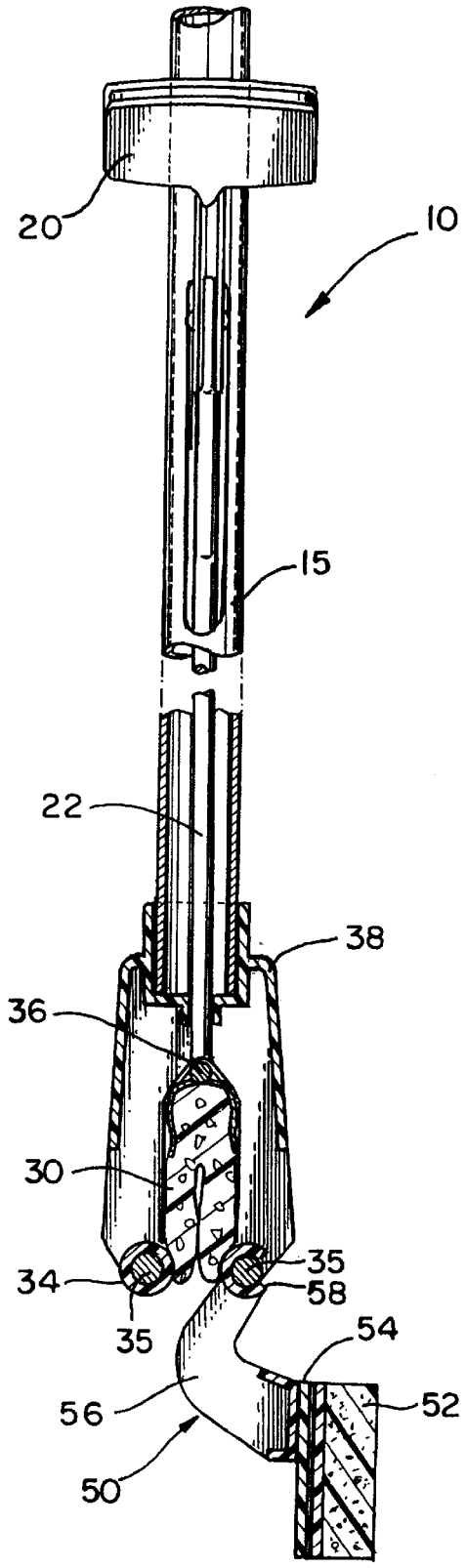
FIG. 3 is an enlarged fragmentary left-side elevational view, partially in section, of the cleaning device illustrated in FIG. 1, illustrating the device actuated toward a wringing position.

Referring now to FIGS. 2 and 3, the mop head 30 is formed of an absorbent material, such as polyurethane, polyester or cellulose sponge. The mop head is disposed between a pair of spaced apart rollers 34 that straddle the mop head 30. The rollers 34 are mounted on a pair of axles 35 that are supported by a bracket 38 attached to the handle 15. A connector 36 connects the mop head 30 to the distal end of a connecting rod. The connecting rod 22 extends through the hollow handle 15 and is pivotally connected to the actuator 20. In the present instance, the actuator 20 is a lever pivotally connected to the handle 15.

The actuator 20 is operable between two positions. The first position or cleaning position is shown in FIG. 2. In this position, the connecting rod is fully extended so that the mop head 30 is disposed below the rollers 34 enabling the user to use the mop head to clean a surface. In FIG. 3, the actuator is disposed in the second position or wringing position. Displacing the actuator toward the wringing position draws the connecting rod 22 upwardly away from the rollers 34, thereby drawing the mop head 30 between the rollers to wring the mop head.

The wiper 50 is pivotally mounted on one of the axles 35 that support the rollers 34. Alternatively, the wiper can be attached directly to one of the rollers 34. The wiper comprises a wiper pad 52 formed of a high-absorbency material so that the wiper pad has a higher absorbency than the mop head 30. In the present instance, the wiper pad 52 is formed of a polyvinylalcohol sponge. The wiper pad 52 is attached to a wiper holder 54 that is a generally rigid flat plate that supports the wiper pad.

The wiper pad may be fixedly connected to the wiper holder 54 such as by an adhesive. However, in the present instance, the wiper pad 52 is removably mounted on the wiper holder by a removable fastener such as a Velcro hook and loop faster. A pair of spaced apart L-shaped connecting arms 56 connect the wiper holder 54 to a cylindrical base 58. The cylindrical base is shaped similarly to the rollers 34 and is rotatably mounted on one of the axles 35 so that the cylindrical base is in operable contact with the mop head 30.

As shown in FIGS. 2 and 3, the wiper 50 is operable between a retracted position and an extended position. Referring to FIG. 2, when the actuator is disposed toward the cleaning position, the wiper 50 is disposed in the retracted position in which the wiper pad 52 is pivoted away from the mop head 30 so that the wiper pad does not interfere with the cleaning operation. Displacing the actuator 20 toward the wringing position draws the mop head 30 upwardly between the rollers 34. Since the cylindrical base 58 of the wiper 50 frictionally engages the mop head 30, the cylindrical base rotates as the mop head 30 is drawn between the rollers. As the cylindrical base 58 rotates, the wiper pad 52 is pivoted into the extended position as shown in FIG. 3. In the extended position, the user can use the wiper pad 52 to absorb residual fluid from the surface being cleaned. After the operator uses the wiper 50, the actuator 20 is pivoted toward the cleaning position, and the wiper pivots upwardly away from the mop head 30 into the retracted position as shown in FIG. 2.

In another aspect of the present invention, one or more components of the cleaning device include scented material applied to the component. For instance, in the present instance, the mop head includes the bracket 38. The bracket is formed of a plastic such as polypropylene. The bracket 38 is formed by injection molding. The plastic is prepared so that a scented material such as a pine scent or a lemon scent is intermixed with the plastic during or before the molding process. In this way, when the bracket is molded, the scented material is permanently incorporated within the bracket 38. Similarly, the rollers 34 can be formed by extrusion wherein the scented material is intermixed with the plastic prior to extrusion. In addition to polypropylene, olefin and ABS styrene plastics can be combined with scented materials to form scented components.

Preferably, the scented component is adjacent an element that is exposed to moisture. Such elements have a tendency to remain moist so that they become malodorous. Placement of the scented component adjacent the malodorous element may serve to overcome the offensive smell.

In addition to utilization with a wringer roller mop, scented components can be incorporated into other cleaning products such as a cleaning brush or a broom. In such an application, the scented material is preferably incorporated into the plastic forming the bristles so that during use the wear on the bristles continuously releases the scented material.

In addition to the foregoing, various receptacles can be formed of plastic that is intermixed with a scented material prior to molding or extrusion. For instance, trash receptacles and mop buckets can be formed from a plastic that is intermixed with a scented material prior to molding.

Accordingly, the terms and expressions that have been employed are used as terms of description and not of limitation. There is no intention in the use of such terms and expressions of excluding any equivalents of the features shown and described or portions thereof. It is recognized, however, that various modifications are possible within the scope of the invention as claimed.

What is claimed is:

1. A cleaning device comprising:

an elongated handle;

a cleaning head attached to the distal end of the handle, the cleaning head comprising:

a sponge; and a pair of rollers spaced apart from one another straddling the sponge;

a connecting rod connected to the sponge;

an actuator connected to the connecting rod, the actuator being operable between first and second positions, whereby displacing the actuator from the first position to the second position displaces the connecting rod thereby drawing the sponge upwardly between the rollers to wring the sponge;

an absorbent pad pivotally connected to the cleaning head, the absorbent pad being formed of a material having a greater absorbency than the cleaning head sponge; and a base connected to the absorbent pad and in operable engagement with the cleaning head sponge;

wherein displacing the actuator from the first position to the second position pivots the absorbent pad from a retracted position to an extended position.

2. The device of claim 1 wherein the absorbent pad is formed from polyvinyl alcohol sponge.

3. The device of claim 1 wherein the absorbent pad is removably attached to the base.

4. The device of claim 1 wherein the base comprises a cylindrical portion in frictional engagement with the cleaning head sponge.

5. A cleaning device comprising:

an elongated handle;

a cleaning head attached to the distal end of the handle, the cleaning head comprising an absorbent material;

an actuator operable between first and second positions, whereby displacing the actuator from the first position to the second position operates to wring the cleaning head;

an absorbent pad pivotally connected to the cleaning head, the absorbent pad being formed of a material having a greater absorbency than the cleaning head, wherein displacing the actuator from the first position to the second position pivots the absorbent pad from a retracted position to an extended position.

* * * * *